United States Patent [19]

Takai et al.

[11] Patent Number: 4,475,020

[45] Date of Patent: Oct. 2, 1984

[54] SLIDE SWITCH OPERATING DEVICE

[75] Inventors: Kazuki Takai; Yasuo Yamada; Satoshi Takagi; Yukio Itoh, all of Tokyo, Japan

[73] Assignee: Clarion Co., Ltd., Tokyo, Japan

[21] Appl. No.: 385,363

[22] Filed: Jun. 7, 1982

[30] Foreign Application Priority Data

| | | | |
|---|---|---|---|
| Jun. 8, 1981 | [JP] | Japan | 56-86822 |
| Jun. 9, 1981 | [JP] | Japan | 56-87514 |
| Jun. 10, 1981 | [JP] | Japan | 56-88037 |

[51] Int. Cl.[3] ..... H01H 15/20

[52] U.S. Cl. ..... 200/153 V; 200/291; 200/16 R

[58] Field of Search ..... 200/153 V, 291, 337, 200/338, 77, 67 E, 252, 16 C, 16 D, 16 E, 16 F, 321-325, 330, 331; 74/527

[56] References Cited

U.S. PATENT DOCUMENTS

| | | | |
|---|---|---|---|
| 1,777,067 | 9/1930 | Amos | 200/77 |
| 1,802,712 | 4/1931 | Graubner | 200/77 |
| 3,174,002 | 3/1965 | Golbeck | 200/16 D |
| 3,258,549 | 5/1966 | Stoi | 200/153 V |
| 3,287,513 | 11/1966 | McFarland | 200/291 X |
| 3,673,365 | 6/1972 | Schadow | 200/153 V X |
| 3,674,953 | 7/1972 | Brevick | 200/77 |
| 3,773,997 | 11/1973 | Evans et al. | 200/153 V X |
| 3,947,391 | 3/1976 | Lutzenberger | 200/16 D |
| 3,965,311 | 6/1976 | Parolin | 200/153 V |
| 4,071,720 | 1/1978 | Kracji et al. | 200/291 X |
| 4,075,492 | 2/1978 | Fuduka et al. | 200/16 F |
| 4,180,712 | 12/1979 | Lutzenberger et al. | 200/16 D |

FOREIGN PATENT DOCUMENTS

| | | | |
|---|---|---|---|
| 1539239 | 1/1979 | United Kingdom | 200/153 V |

*Primary Examiner*—Stephen Marcus

*Assistant Examiner*—Ernest G. Cusick

*Attorney, Agent, or Firm*—Flynn, Thiel, Boutell & Tanis

[57] ABSTRACT

An operating device for switching a slide switch by moving a slide member of the slide switch in response to movement of an operating member includes an acting member which is provided on the operating member, is engageable with the slide member, and is movable against elastic force of an elastic member. The elastic force is slightly larger than the force necessary for slidable movement of the slide member and the stroke of the operating member is larger than that of the slide member.

11 Claims, 18 Drawing Figures

SLIDE SWITCH OPERATING DEVICE

FIELD OF THE INVENTION

This invention relates to a slide switch operating device.

BACKGROUND OF THE INVENTION

Movement stroke of an operating member for causing sliding movement of a slide member of a slide switch, in general, has to match a stroke just to slide the slide member. That is, if the stroke of the operating member exceeds the desired one, too large a load is applied to the slide members, etc. and can damage a slide switch, etc. while if the stroke is smaller, the slide switch cannot be fully changed over, causing mis-operation of the switch.

In this connection, various adjust means have conventionally been provided in order to conform the stroke of the operating member with the desired one. FIGS. 1 and 2 show an example of such structure where an adjust member 3 is secured to one end of a slide member 2 of a slide switch 1 so that legs 4 thereof are located within an opening 6 of an operating member 5. As shown in FIG. 7, the resiliently deflectable plates or tabs 9 and 9' each have an end portion which is bent downwardly toward the operating member 5, the distance between the bent end portions being slightly less than the width of the operating member 5. Then, the stroke is adjusted by narrowing the distance between the legs 4 as shown in FIG. 4(*a*) when the stroke A (FIG. 3) of the operating member 5 is larger than the stroke B+C necessary for slidable movement of the slide member 2 or by expanding the legs 4 as shown in FIG. 4(*b*) when the stroke A is smaller than the stroke B+C so that the slide member is pushed to the right by the adjust member 3 when the operating member 5 is positioned at the rightmost end as shown in FIG. 3(*a*), while the slide member 2 is pulled to the left by the adjust member 3 when the operating member, passing over the position as shown in FIG. 3(*b*), reaches the leftmost end as shown in FIG. 3(*c*).

FIG. 5 shows another example of a structure for adjusting the stroke in which legs 4' are provided on an operating member 5' so as to be astride an assistant member 7 secured to one end of a slide member which is not shown. FIGS. 6(*a*) and (*b*) show a further example in which legs 4'' are provided on an operating member 5'' so as to directly engage an end of the slide member 2. In these examples, also, the stroke is adjusted by narrowing or expanding the distance between the legs.

Those conventional structures certainly make it possible to adjust the stroke. However, matching the stroke by such adjustment not only requires time, but also is extremely difficult. Therefore, overload to the slide member or mis-operation of the switch could not effectively be prevented. Accordingly, it has not been possible to always operate the slide switch with stability and accuracy.

THE OBJECT OF THE INVENTION

It is therefore an object of the present invention to overcome such drawbacks in conventional devices by providing a slide switch operating device capable of always stably and accurately operating the slide switch without requiring adjustment for matching the stroke of the operating member with the desired one.

SUMMARY OF THE INVENTION

In accordance with the present invention, there is provided a slide switch operating device which comprises:

an operating member movably mounted;

an assist member mounted at an end of a slide member of said slide switch;

an acting member so supported on said operating member as to be engageable with said assist member;

said acting member being movable relative to said operating member in response to a force slightly larger than the force necessary for slidable movement of said slide member, the movable stroke of the operating member being slightly larger than that necessary for slidable movement of said slide member.

BRIEF DESCRIPTION OF THE DRAWINGS

FIGS. 8(*b*), (*c*), (*d*), (*e*) are views similar to FIG. 8(*a*) for explaining the operation of members which are shown in FIG. 8(*a*);

FIGS. 11(*b*), (*c*) and (*d*) are views similar to FIG. 11(*a*) for explaining the operation of members which are shown in FIG. 11(*a*);

FIGS. 16(*b*) and (*c*) are views similar to FIG. 16(*a*) for explaining the operation of members which are shown in FIG. 16(*a*).

DETAILED DESCRIPTION OF THE PREFERRED EMBODIMENTS

Figure 1:
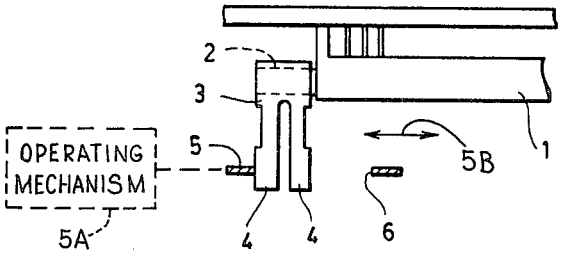
FIG. 1 PRIOR ART
FIG. 1 shows a partially-cut off and vertically sectioned view of an example of a prior art device.
Figure 2:
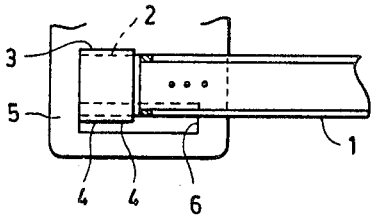
FIG. 2 PRIOR ART
FIG. 2 is a transversely sectioned plan view of the prior art device of FIG. 1.
Figure 3:
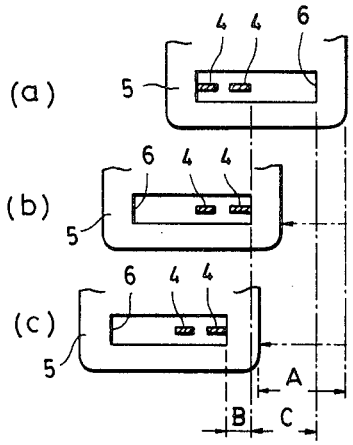
FIG. 3 PRIOR ART
FIGS. 3(*a*), (*b*) and (*c*) are sectional plan views for explaining the operation of the prior art device in FIGS. 1 and 2.
Figure 4A:
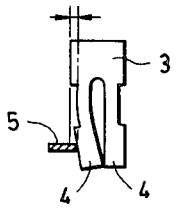
FIG. 4(a) PRIOR ART
FIGS. 4(*a*) and (*b*) are sectional views for explaining methods of adjusting the stroke of the prior art device of FIG. 1.
Figure 4B:
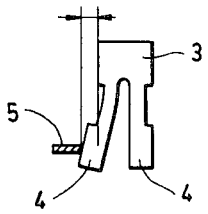
FIG. 4(b) PRIOR ART
Figure 5:
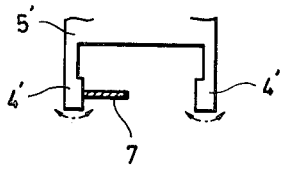
FIG. 5 PRIOR ART
FIG. 5 is a transversely sectioned plan view illustrating part of a different prior art device.
Figure 6A:
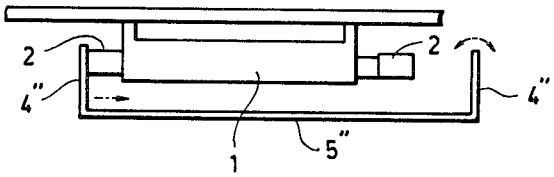
FIG. 6(a) PRIOR ART
FIGS. 6(*a*) and (*b*) are partially-cut off front views illustrating a further prior art device.
Figure 6B:
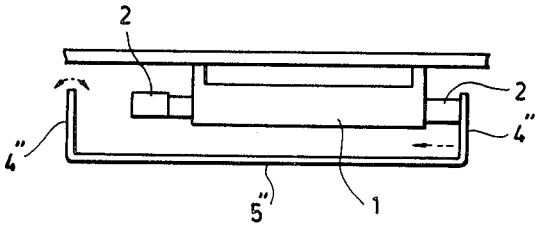
FIG. 6(b) PRIOR ART
Figure 7:
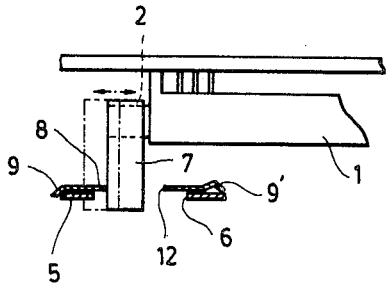
FIG. 7 is a partially-cut off and vertically sectioned front view illustrating a device emboding the present invention.
Figure 8:
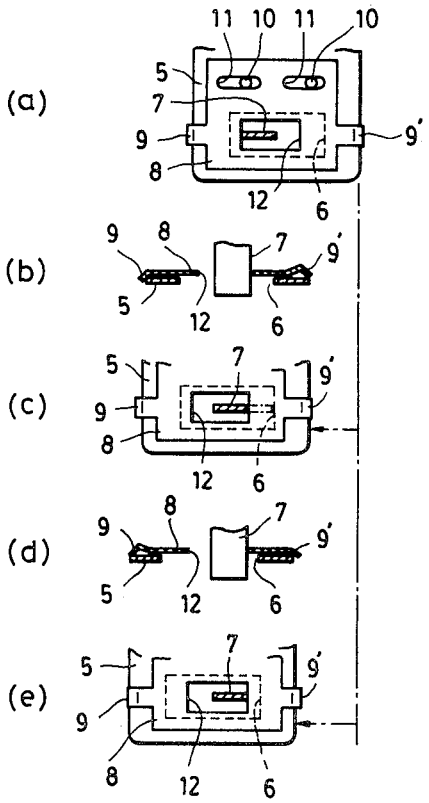
FIG. 8(*a*) is a transversely sectioned plan view of part of the device of FIG. 7.

As shown in FIGS. 7 and 8, an assist member 7 is secured to an end of a slide member 2 of a slide switch 1 while an actuating member or acting member 8 having nail-like elastic plates or tabs 9 and 9′ at both ends thereof is so supported on an operating member 5 as to be movable along elongated holes or slots 11 which receive pins 10 provided on the operating member 5 so that the assist member 7, passing through an opening 12 of the acting member 8, also passes through an opening 6 of the operating member 5. The operating member 5 is supported for reciprocal movement in the directions indicated by arrow 5B under the control of a control mechanism 5A. The control mechanism 5A could, for example, be the auto-reverse mechanism of a tape recorder. The control mechanism 5A is conventional and not a part of the subject matter of the present invention, and is therefore not disclosed in detail. The nail-like elastic plates 9 and 9′ are so arranged that one of them can engage an end edge of the operating member 5 when the other rides on the upper surface of the operating member against the elastic force. The elastic force of the nail-like elastic plates 9 and 9′ is designed so that the force required to effect relative movement of the operating member and acting member is slightly larger than the force necessary for slidable movement of the slide member 2 and the stroke of the operating member 5 is slightly larger than that of the slide member 2.

With this arrangement, when the operating member 5 is located at the rightmost position as shown in FIG. 8(*a*), the right one 9′ of the nail-like elastic plates of the acting member 8 rides on the surface of the operating member while the left one 9 is in engagement with the edge thereof, so that the slide member 2 is in a rightwardly pushed-in condition as shown by solid line in FIG. 7 through cooperation between the opening 12 of the acting member 8 and the assist member 7 which is in engagement with the acting member 8. When the operating member 5 moves leftward from that position, the acting member 8 also moves leftward up to the position as shown in FIGS. 8(*b*) and (*c*), together with the operating member 5, due to the elastic force of the nail-like elastic plate 9 which is in engagement with the leftmost edge of the operating member 5. At this time, since the opening 12 of the acting member 8 brings the assist member 7 to the left, the slide member 2 comes to be pulled out to the left as shown by chained line in FIG. 7. This means that the slide switch 1 has been changed over. The operating member 5 further moves to the left from that position. However, the slide member 2 does not slide to the left any more. So, the nail-like elastic plate 9 of the acting member 8 rides onto the operating member 5 and the acting member 8 stops there. When the operating member 5 reaches the leftmost position as shown in FIGS. 8(*d*) and (*e*), the nail-like elastic plate 9 is completely on the operating member 5 and the other nail-like elastic plate 9′ is in engagement with the associated edge of the operating member 5. When the operating member 5 moves to the right from that position, the acting member 8, after changing over the slide switch 1 to the contrary, returns to the position as shown in FIG. 8(*a*) with its nail-like elastic plate 9′ riding on the operating member and the other elastic plate 9 in close contact with the associated edge of the operating member 5.

Although the nail-like elastic plates 9 and 9′ are provided on the acting member 8 in the embodiment of FIG. 7, they may alternatively be formed on the operating member 5. Also, the elastic plates 9 and 9′ may be formed integrally with the acting member 8 or operating member 5 and may be formed in other shapes. Further, although the acting member 8 is mounted for linear movement in the above-referred embodiment, it may be arranged to move in a circular direction. The same embodiment is so designed that the opening 12 of the acting member gets in engagement with the member 7. However, it is not limited to such structure.

Besides these, the above embodiment may be put in various modifications and alterations.

According to the embodiment in FIG. 7 which is described above, it is not necessary to do adjustment for matching the stroke of the operating member with that necessary for slidable movement of the slide member. Additionally, the slide switch can always be operated in a stable and accurate manner without applying a load in excess of the elastic force of the elastic plate to the slide member, etc. and causing mis-operation of the slide switch. Therefore, it is suitable for an auto-reverse mechanism for automatic changeover of the tape direction in a tape recorder and other various uses.

Figure 9:
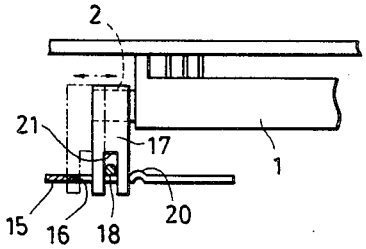
FIG. 9 is a partially-cut off and vertically sectioned plan view of a further embodiment according to the present invention.
Figure 10:
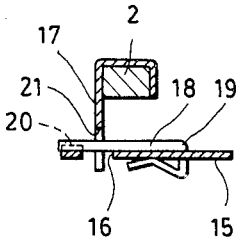
FIG. 10 is a vertically sectioned side view of part of the embodiment of FIG. 9.
Figure 11:
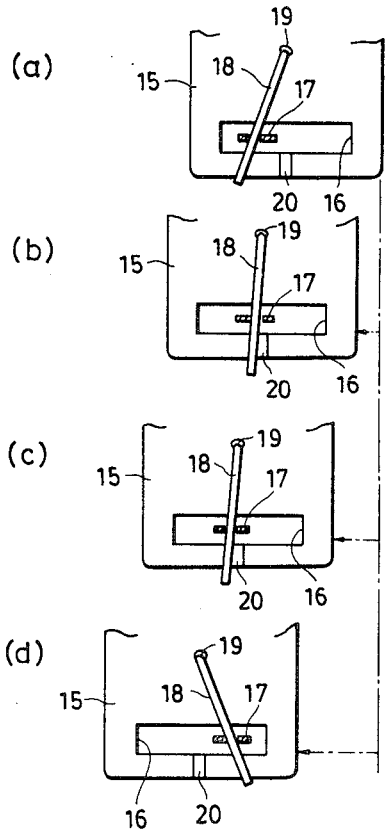
FIG. 11(*a*) is a transversely sectioned plan view of the device of FIG. 9.

FIGS. 9 to 11 show another embodiment according to the present invention in which an assist member 17 is secured to an end of the slide member 2 of the slide switch 1 while an acting member 18 having a rod-like configuration is mounted on the operating member 15 for pivotal movement about its end 19 and so as to pass over a protruding detent or click 20. The assist member 17 is located within an opening 16 of an operating member 15 with a groove or opening 21 thereof receiving the acting member 18 in it. The force necessary for causing the acting member 18 to pass over the protruded click 20 is designed slightly larger than force necessary for slidable movement of the slide member 2, while the stroke of the operating member 15 is designed slightly larger than that necessary for slidable movement of the slide member 2.

With this arrangement, when the operating member 15 is positioned in the rightmost position, as shown in FIG. 11(*a*), the acting member 18 is located to the left of the protruding click 20 and the slide member 2 is in its rightwardly pushed-in condition as shown by solid line in FIG. 9. When the operating member 15 moves to the left from that position, first the click 20 gets in contact with the acting member 18 at the position as shown in FIG. 11(*b*), and next the acting member also moves to the left to reach the position as shown in FIG. 11(*c*) together with the operating member 15, due to the resistance force of the click 20. As the acting member 18 brings the assist member 17 to the left through cooperation with the groove 21, the slide member 2 comes to be pulled out to the left as shown by chained line in FIG. 9. This means that the slide switch 1 has been changed over. Although the operating member 15 further moves to the left, the slide member 2 does not slide to the left any more. So, the operating member 18 rotates to the right, passing over the click 20 against the resistance force of the click 20, to make such an angle as shown in FIG. 11(*d*) when the operating member 15 reaches the position as shown in the same figure. Then, when the operating member 15 moves to the right from that position, the acting member 18, after changing over the slide switch 11 to the contrary, rotates to the left, passing over the click 20 again, to return the position for making the angle as shown in FIG. 11(*a*).

Figure 12:
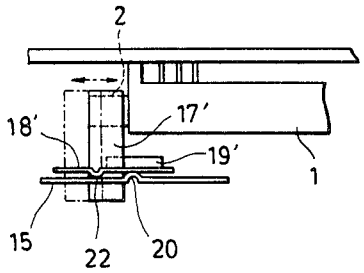
FIG. 12 is a partially cut off front view of a still further embodiment according to the present invnetion.
Figure 13:
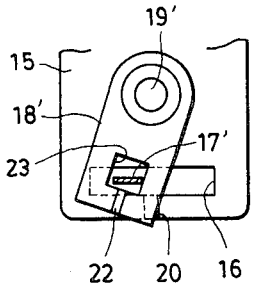
FIG. 13 is a transversely sectioned plan view of FIG. 12.

FIGS. 12 and 13 show a further embodiment according to the present invention in which an acting member 18' in a flat plate configuration having a downwardly projecting click 22 is so mounted as to be rotatable about a support member 19'. An assist member 17' extends through an opening 23 of the acting member 18' and an opening 16 of the operating member 15. The force required for the clicks 20 and 22 to pass each other is designed slightly larger than the force necessary for slidable movement of the slide member 2. The other structure is same as the embodiment shown in FIGS. 9 to 11.

With this arrangement, the various components function substantially same as in the embodiment of FIGS. 9 to 11. If the support member 19' is so designed as to be threadedly supported on the operating member 15, the resistance force required for the clicks 20 and 22 to pass over each other can be adjusted by increasing or the inserted length of the supported member 19'.

It should be noted that, although the click 20 is made in a protruding manner, it may alternatively have a concave shape. In this case, the resistance force of the click 20 is the force at the time when the acting member 18 or the click 22 rides onto the upper surface of the operating member 15 from the condition where it is in the click 20. Further, although the operating member 18 or 18' is pivotally mounted in the above-referred embodiments, it may be so mounted as to be linearly movable.

According to the embodiments as shown in FIGS. 9 to 13, it is not necessary to do adjustment for matching the stroke of the operating member with that necessary for slidable movement of the slide member. Additionally, the slide switch can always be operated in a stable and accurate meanner without applying a load in excess of the resistance force of the click of the operating member to the slide member, etc. and causing mis-operation of the slide switch. Therefore, it is suitable for an auto-reverse mechanism for automatic changeover of the tape direction in a tape recorder and other various uses.

Figure 14:
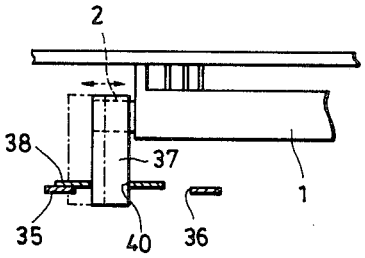
FIG. 14 is a partially-cut off and sectioned plan view of a still further embodiment according to the present invention.
Figure 15:
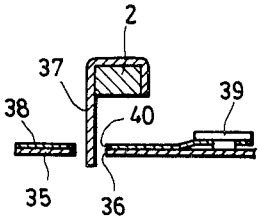
FIG. 15 is a vertically sectioned side view of part of the embodiment of FIG. 14.
Figure 16:
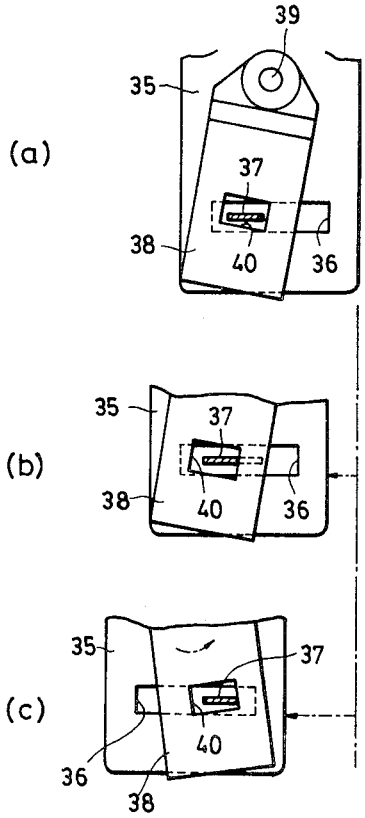
FIG. 16(*a*) is a transversely sectioned plan view of part of the embodiment of FIG. 14.

FIGS. 14 to 16 show a still further embodiment according to the present invention in which an assist member 37 is secured to an end of the slide member 2 of the slide switch 1. A flat plate-like acting member 38 is so mounted on an operating member 35 as to be pivotable about a support member 39. The assist member 37, passing through an opening 40 of the acting member 38, is located within an opening 36 of the operating member 35. Frictional force between the acting member 38 and the operating member 35 is designed to be slightly larger than force necessary for slidable movement of the slide member 2, while the stroke of the operating member is designed slightly larger than the stroke necessary for slidable movement of the slide member 2.

With this arrangement, when the operating member 35 is located at the rightmost position as shown in FIG. 16(*a*), the slide member 2 is in the rightwardly pushed-in condition as shown by solid line in FIG. 14, due to cooperation between the opening 40 of the acting member 38 and the assist member 37 which is disposed in the opening 40. When the operating member 35 is moved to the left from that position, the acting member 38 also moves to the left up to the position as shown in FIG. 16(*b*) due to the frictional force between the operating member 35 and itself. At this time, the opening 40 of the acting member 38 brings the assist member 37 to the left, causing the slide member 2 to be pulled out to the left as shown by chained line in FIG. 14. This means that the slide switch has been changed over. Although the operating member 35 further moves to the left, the slide member 2 does not move to the left any more. So, the acting member 38 rotates against the frictional force between the operating member 35 and itself to thereby make an angle as shown in FIG. 16(*c*) when the operating member 35 reaches the leftmost position as shown in the same figure. When the operating member moves to the right from that position, the acting member, after moving the slide member to its original position, rotates again and returns to the position shown in FIG. 16(*a*).

If the support member 39 is so arranged to be threadedly supported on the operating member 35, the frictional force between the acting member 38 and the operating member 35 can be adjusted by increasing or decreasing the inserted amount of the support member 39. The acting member, which is rotatable in the above-referred embodiment, may be so designed as to move linearly. Further, the present invention is not limited to the same embodiment so arranged that the opening 40 of the acting member 38 engages with the assist member.

According to the embodiment as shown in FIGS. 14 to 16, it is not necessary to do adjustment for matching the stroke of the operating member with that necessary for slidable movement of the slide member. Additionally, the slide switch can always be operated with stability and accuracy without applying to the slide member, etc. too heavy load in excess of the frictional force between the acting member and the operating member and causing mis-operation of the slide switch. Therefore, it is suitable for an auto-reverse mechanism for automatic changeover of the tape direction in a tape recorder and other various uses.

The embodiments of the invention in which an exclusive property or privilege is claimed are defined as follows:

1. A mechanism for operating a slide switch having a slide member supported for movement in a direction between first and second positions, comprising an actuating member supported for movement substantially parallel to said direction; first means operatively coupling said actuating member and said slide member; an operating member supported for movement substantially parallel to said direction relative to said slide member and said actuating member between third and fourth positions, the distance moved by said operating member between said third and fourth positions being greater than the distance moved by said slide member between said first and second positions; and second means cooperable with said operating member and said actuating member for yieldably resisting relative movement of said operating member and said actuating member, the force in said direction required to effect movement of said operating member relative to said actuating member being greater than the force in said direction required to effect movement of said slide member;

wherein said operating member has a surface thereon which extends substantially parallel to said direction, wherein said actuating member is a plate which is movably supported on said surface of said operating member substantially parallel thereto, and wherein said second means includes a resiliently deflectable tab which projects outwardly from said actuating member substantially in said direction and has a portion at the outer end thereof which is bent toward said operating member, engagement of said resilient tab and said operating member effecting said yieldable resisting of relative movement of said operating member and said actuating member.

2. The mechanism according to claim 1, wherein said operating member is a plate having said surface on one side thereof, and including two said resiliently deflectable tabs which project outwardly from opposite sides of said actuating member, the distance between said bent end portions of said resiliently deflectable tabs being slightly less than the width in said direction of said operating member, said bent end portion of a respective one of said tabs being in engagement with said surface of said operating member when said operating member and said actuating member are in said third and fourth positions, respectively.

3. The mechanism according to claim 2, including a slot provided in said actuating member and extending substantially in said first direction, and including a pin which is provided on said operating member, extends substantially perpendicular to said surface thereon, and is slidably received in said slot in said actuating member.

4. The mechanism according to claim 2, wherein said actuating member is movable in said direction relative to said slide member; and wherein said first means includes said operating member having an opening therethrough, said actuating member having an opening therethrough which is aligned with said opening in said operating member in all relative positions of said operating member and said actuating member, and said slide member having an assist portion which extends approximately perpendicular to said direction and extends through said openings in said operating member and said actuating member, said opening through said actuating member having a dimension in said direction which is greater than the dimension in said direction of said assist portion of said slide member and is less than the dimension in said direction of said opening through said operating member.

5. A mechanism for operating a slide switch having a slide member supported for movement in a direction between first and second positions, comprising an actuating member supported for movement substantially parallel to said direction; first means operatively coupling said actuating member and said slide member; an operating member supported for movement substantially parallel to said direction relative to said slide member and said actuating member between third and fourth positions, the distance moved by said operating member between said third and fourth positions being greater than the distance moved by said slide member between said first and second positions; and second means cooperable with said operating member and said actuating member for yieldably resisting relative movement of said operating member and said actuating member, the force in said direction required to effect movement of said operating member relative to said actuating member being greater than the force in said direction required to effect movement of said slide member;

wherein said operating member has a surface thereon which extends generally parallel to said direction, and wherein said actuating member is supported for pivotal movement about an axis substantially perpendicular to said surface and is operatively coupled to said slide member at a location spaced radially from said axis.

6. The mechanism according to claim 5, wherein said second means includes detent means cooperable with said actuating member and said operating member at a location spaced radially from said axis for effecting said yieldable resisting of relative movement thereof.

7. The mechanism according to claim 6, wherein said operating member is a plate having an opening therethrough; wherein said actuating member is movable substantially in said direction relative to said slide member; wherein said first means includes said slide member having an assist portion which extends substantially perpendicular to said direction, has a dimension in said direction substantially less than the dimension in said direction of said opening through said operating member, is received in said opening through said operating member, and has an opening extending therethrough substantially perpendicular to said assist portion and to said direction; wherein said first means includes said actuating member being an elongate rod extending substantially parallel to said surface and substantially perpendicular to said assist portion, said elongate rod being supported at one end for pivotal movement about said axis and a portion of said rod spaced radially from said axis being received in said opening in said assist portion of said slide member; and wherein said detent means includes a projection on said surface of said operating member at a location spaced radially from said axis, said projection engaging said rod as said rod pivots relative to said operating member and yieldably resisting such pivotal movement of said rod.

8. The mechanism according to claim 5, wherein said actuating member is a plate which is supported on said surface substantially parallel thereto; wherein said actuating member is movable substantially in said direction relative to said slide member; wherein said first means includes said actuating member having an opening therethrough at a location spaced radially from said axis, said operating member having an opening therein which has a dimension in said direction substantially larger than that of said opening in said actuating member, said opening in said actuating member being aligned with said opening in said operating member in all relative positions of said actuating member and said operating member, and said slide member having an assist portion which is substantially perpendicular to said direction and extends through said openings in said actuating member and said operating member, said assist portion having a dimension in said direction which is less than that of said opening in said actuating member.

9. The mechanism according to claim 8, wherein said second means includes detent means cooperable with said operating member and said actuating member at locations spaced radially from said axis for effecting said yieldable resisting of relative movement of said operating member and said actuating member.

10. The mechanism according to claim 9, wherein said detent means includes a projection on said surface of said operating member and includes a projection on a surface of said actuating member which faces said operating member, said projections being engageable with each other to effect said yieldable resisting of relative movement of said operating member and said actuating member.

11. The mechanism according to claim 8, wherein said second means includes said actuating member having a surface which frictionally engages said surface on said operating member, said frictional engagement of said surfaces effecting said yieldable resisting of relative movement of said actuating member and said operating member.

* * * * *